US009273917B1

(12) United States Patent
Buckner

(10) Patent No.: US 9,273,917 B1
(45) Date of Patent: Mar. 1, 2016

(54) MAGAZINE LOADER

(71) Applicant: Patrick T. Buckner, San Tan Valley, AZ (US)

(72) Inventor: Patrick T. Buckner, San Tan Valley, AZ (US)

( * ) Notice: Subject to any disclaimer, the term of this patent is extended or adjusted under 35 U.S.C. 154(b) by 0 days.

(21) Appl. No.: 14/617,360

(22) Filed: Feb. 9, 2015

(51) Int. Cl.
*F41A 9/84* (2006.01)
*F41A 9/83* (2006.01)
*F41A 9/66* (2006.01)

(52) U.S. Cl.
CPC ... *F41A 9/83* (2013.01); *F41A 9/66* (2013.01); *F41A 9/84* (2013.01)

(58) Field of Classification Search
CPC ..... F41A 9/82; F41A 9/83; F41A 9/84; F41A 9/85; F41A 9/66; F41A 9/67
USPC ..... 42/87, 88
See application file for complete search history.

(56) References Cited

U.S. PATENT DOCUMENTS

| | | | | |
|---|---|---|---|---|
| 4,074,511 | A | 2/1978 | Chambley et al. | |
| 4,706,402 | A * | 11/1987 | Csongor | F41A 9/84 42/87 |
| 5,355,606 | A | 10/1994 | Origoni | |
| D477,047 | S | 7/2003 | Springer | |
| 6,754,987 | B1 | 6/2004 | Cheng et al. | |
| 2007/0137086 | A1 | 6/2007 | Price | |

FOREIGN PATENT DOCUMENTS

| | | | |
|---|---|---|---|
| DE | 3720496 | * | 1/1989 |
| GB | 379179 | * | 8/1932 |

* cited by examiner

*Primary Examiner* — Stephen M Johnson
(74) *Attorney, Agent, or Firm* — R. Keith Harrison

(57) ABSTRACT

A magazine loader includes a loader housing having a housing interior; an ammo slot in the loader housing, the ammo slot communicating with the housing interior; a clip slot in the loader housing opposite the ammo slot, the clip slot communicating with the housing interior; and an ammo loading plunger carried by the loader housing and extending into the housing interior, the ammo loading plunger positional between an extended ammo preloading position and a retracted ammo loading position in the housing interior.

18 Claims, 8 Drawing Sheets

MAGAZINE LOADER

FIELD

Illustrative embodiments of the disclosure generally relate to stripper clips which load ammunition into firearms. More particularly, illustrative embodiments of the disclosure generally relate to a magazine loader which quickly and safely loads ammunition into an ammo magazine for a firearm in the field for military, police, recreational or other applications.

SUMMARY

Illustrative embodiments of the disclosure are generally directed to a magazine loader which quickly and safely loads ammunition into an ammo magazine for a firearm in the field for military, police, recreational or other applications. An illustrative embodiment of the magazine loader includes a loader housing having a housing interior; an ammo slot in the loader housing, the ammo slot communicating with the housing interior; a clip slot in the loader housing opposite the ammo slot, the clip slot communicating with the housing interior; and an ammo loading plunger carried by the loader housing and extending into the housing interior, the ammo loading plunger positional between an extended ammo preloading position and a retracted ammo loading position in the housing interior.

BRIEF DESCRIPTION OF THE DRAWINGS

Illustrative embodiments of the disclosure will now be described, by way of example, with reference to the accompanying drawings, wherein.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "top" and "bottom" are used in aid in an understanding of the illustrative embodiments of the magazine loader and are not intended to be construed in a limiting sense.

Figure 9:
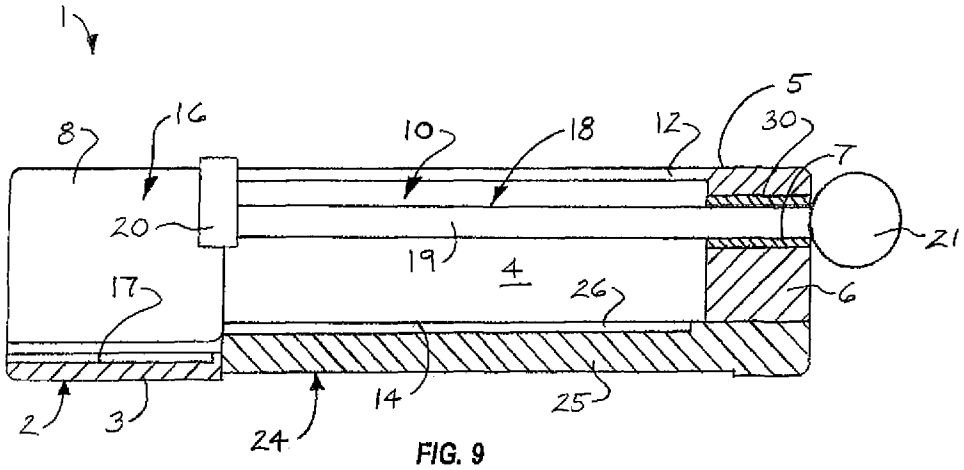
FIG. 9 is a longitudinal sectional view, taken along section lines 9-9 in FIG. 5, of the illustrative magazine loader, with the ammo loading plunger disposed in the retracted ammo loading position.
Figure 10:
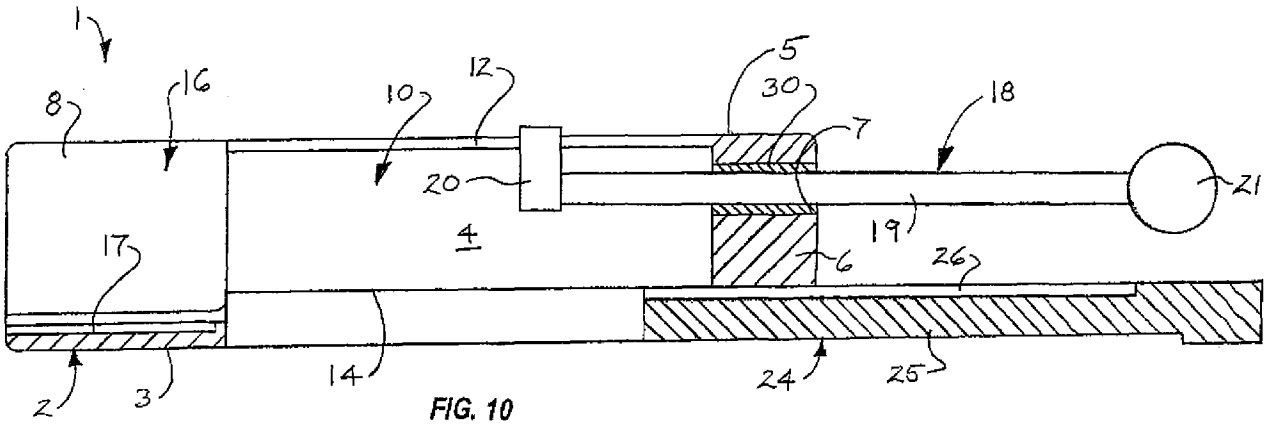
FIG. 10 is a longitudinal sectional view, taken along section lines 9-9 in FIG. 5, of the illustrative magazine loader, with the ammo loading plunger disposed in a partially-retracted ammo loading position.

Referring initially to FIGS. 1-10 of the drawings, an illustrative embodiment of the magazine loader is generally indicated by reference numeral 1. The magazine loader 1 includes a loader housing 2 which may be generally elongated and rectangular in shape. The loader housing 2 may be fabricated of steel, aluminum, composite material and/or other material or materials which are consistent with the functional requirements of the magazine loader 1 using conventional manufacturing techniques and processes known by those skilled in the art. The loader housing 2 may include a pair of generally elongated, parallel, spaced-apart housing sides 4. A housing end 6 may connect the housing sides 4 at one end of the loader housing 2. The housing sides 4 and the housing end 6 may have a housing top surface 5. A housing interior 10 is formed by and between the housing sides 4 and the housing end 6. An elongated ammo slot 12 extends into the housing top surface 5 and communicates with the underlying housing interior 10, as illustrated in FIGS. 9 and 10.

Figure 1:
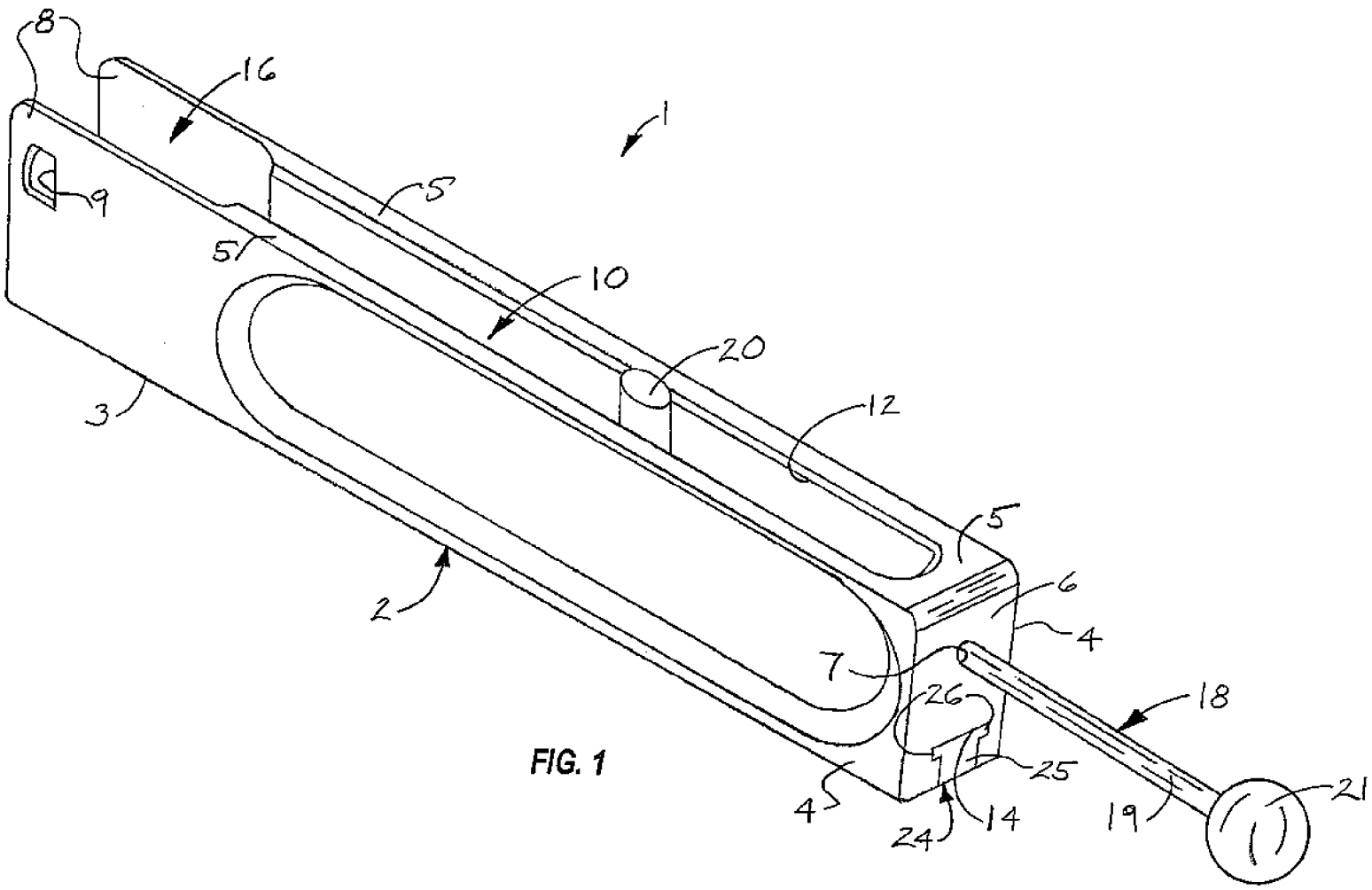
FIG. 1 is a perspective view of an illustrative embodiment of the magazine loader.
Figure 2:
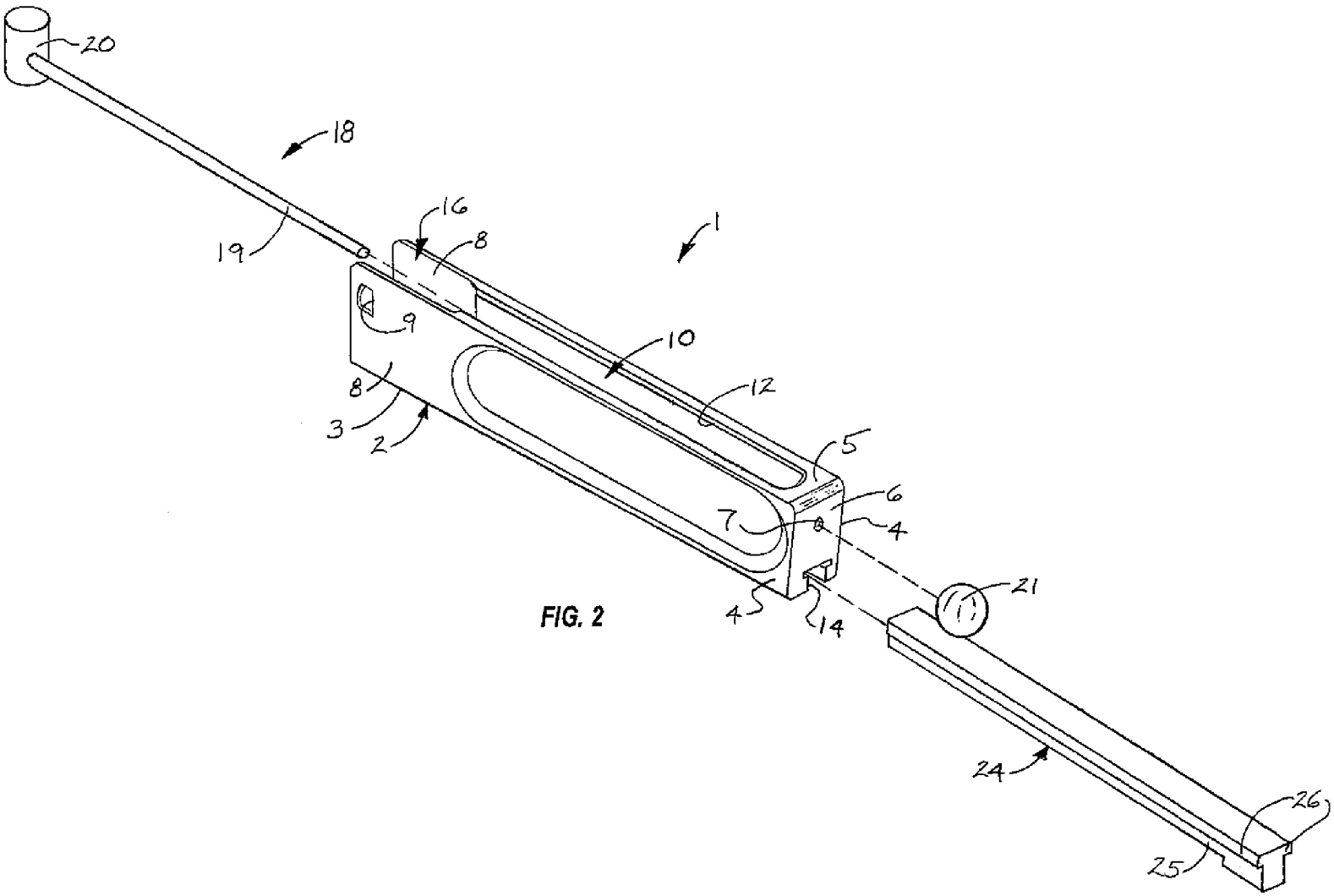
FIG. 2 is an exploded perspective view of an illustrative embodiment of the magazine loader.
Figure 3:
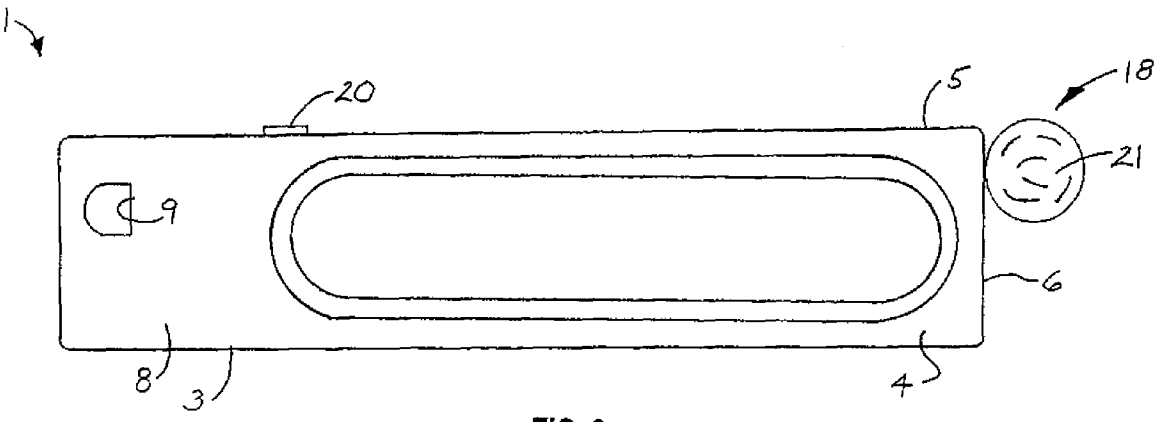
FIG. 3 is a side view of the illustrative magazine loader, with an ammo loading plunger deployed in a retracted ammo loading position.
Figure 4:
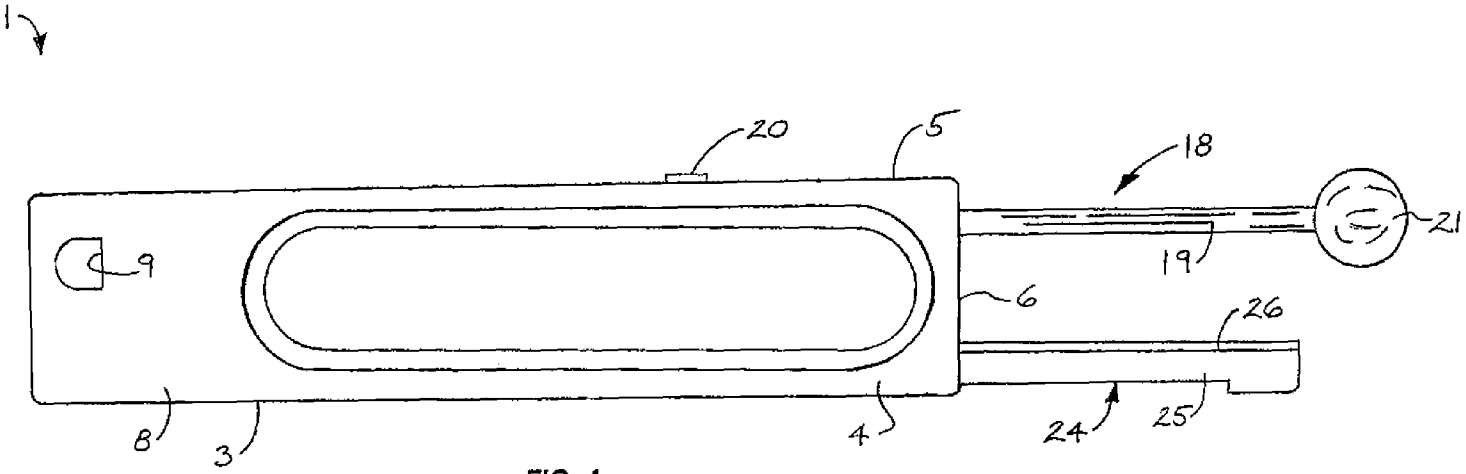
FIG. 4 is a side view of the illustrative magazine loader, with the ammo loading plunger deployed in an extended ammo preloading position.
Figure 5:
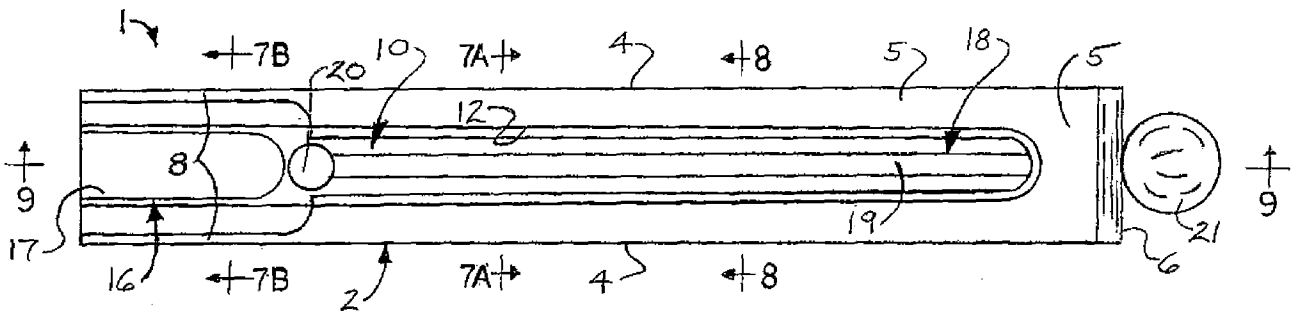
FIG. 5 is a top view of the illustrative magazine loader.

A pair of tapered housing end portions 8 may extend from the respective housing sides 4 at the end of the loader housing 2 which is opposite the housing end 6. A housing bottom 3 may extend between the tapered housing end portions 8. A magazine space 16 may be formed by and between the housing end portions 8 and the housing bottom 3. A magazine insertion slot 17, extending parallel to a longitudinal axis of the loader housing 2, may be provided in the housing bottom 3. The magazine insertion slot 17 communicates with the magazine space 16. As illustrated in FIGS. 1 and 2, in some embodiments, a magazine tab opening 9 may extend through one of the wall end portions 8 to facilitate attachment of an ammo magazine 34 (FIGS. 11-15) to the loader housing 2 as the ammo magazine 34 is inserted in the magazine space 16 and the magazine insertion slot 17, as will be hereinafter described.

Figure 6:
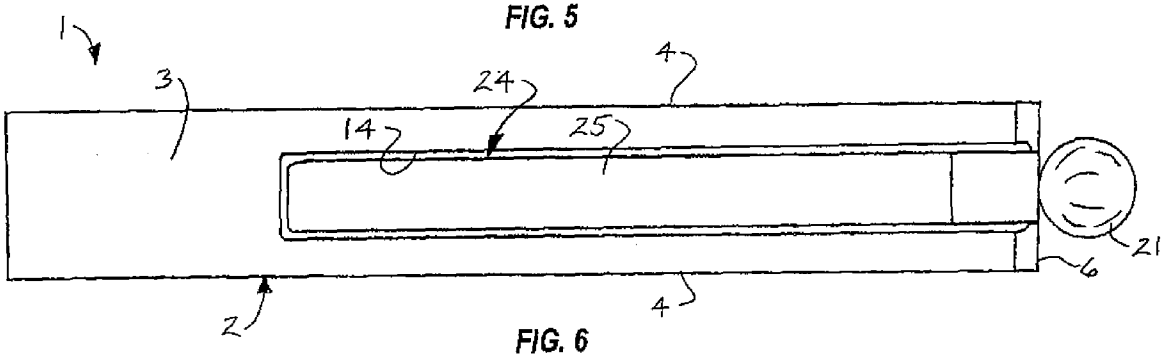
FIG. 6 is a bottom view of the illustrative magazine loader.
Figure 8:
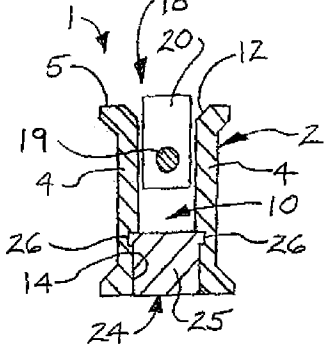
FIG. 8 is a cross-sectional view, taken along section lines 8-8 in FIG. 5, of the illustrative magazine loader.
Figure 7B:
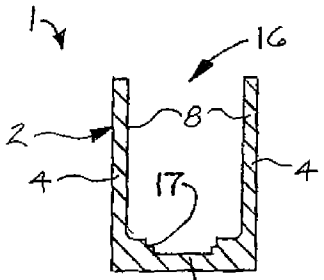
FIG. 7B is a cross-sectional view, taken along section lines 78-7B in FIG. 5, of the illustrative magazine loader.
Figure 7A:
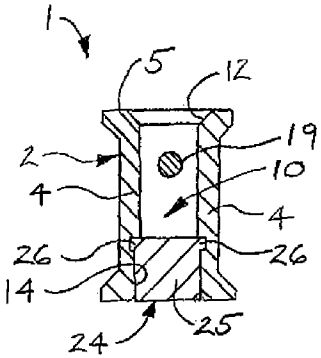
FIG. 7A is a cross-sectional view, taken along section lines 7A-7A in FIG. 5, of the illustrative magazine loader.

As illustrated in FIGS. 6, 9 and 10, in some embodiments, a clip slot 14 may be formed by and between the housing sides 4 opposite the ammo slot 12. The clip slot 14 may extend from the housing bottom 3 through the housing end 6 of the loader housing 2. The clip slot 14 may communicate with the overlying housing interior 10. An elongated ammo support rail 24 may engage the clip slot 14 in sliding relation thereto. As illustrated in FIG. 2, the ammo support rail 24 may include a generally elongated rail body 25. A pair of rail flanges 26 may extend from and along opposite sides of the rail body 25. Accordingly, the rail flanges 26 of the ammo support rail 24 may slidably engage the complementary-shaped clip slot 14 to slidably and detachably mount the ammo support rail 24 in the clip slot 14 for purposes which will be hereinafter described.

An ammo loading plunger 18 includes a plunger rod 19 which slidably engages the loader housing 2 according to the knowledge of those skilled in the art. Accordingly, as illustrated in FIGS. 1 and 2, in some embodiments, a rod opening 7 may extend through the housing end 6 of the loader housing 2. The plunger rod 19 of the ammo loading plunger 18 may extend through the rod opening 7. As illustrated in FIGS. 9 and 10, a plunger rod bushing 30 may be seated in the rod opening 7. The plunger rod 19 may extend through the plunger rod bushing 30. A plunger head 20 terminates the plunger rod 19 inside the housing interior 10. The plunger head 20 may be generally elongated and cylindrical in shape and may protrude from the housing interior 10 through the amino slot 12. A plunger handle 21 may terminate the plunger rod 19 outside the housing interior 10. Accordingly, the ammo loading plunger 18 extends through and in sliding relation to the plunger rod bushing 30 and can be selectively deployed between the extended ammo preloading position illustrated in FIG. 12 and the retracted ammo loading position illustrated in FIG. 13. Accordingly, the plunger head 20 of the ammo loading plunger 18 may traverse the ammo slot 12 from the housing end 6 at the ammo preloading position to between the housing end portions 8 at the ammo loading position.

Figure 11:
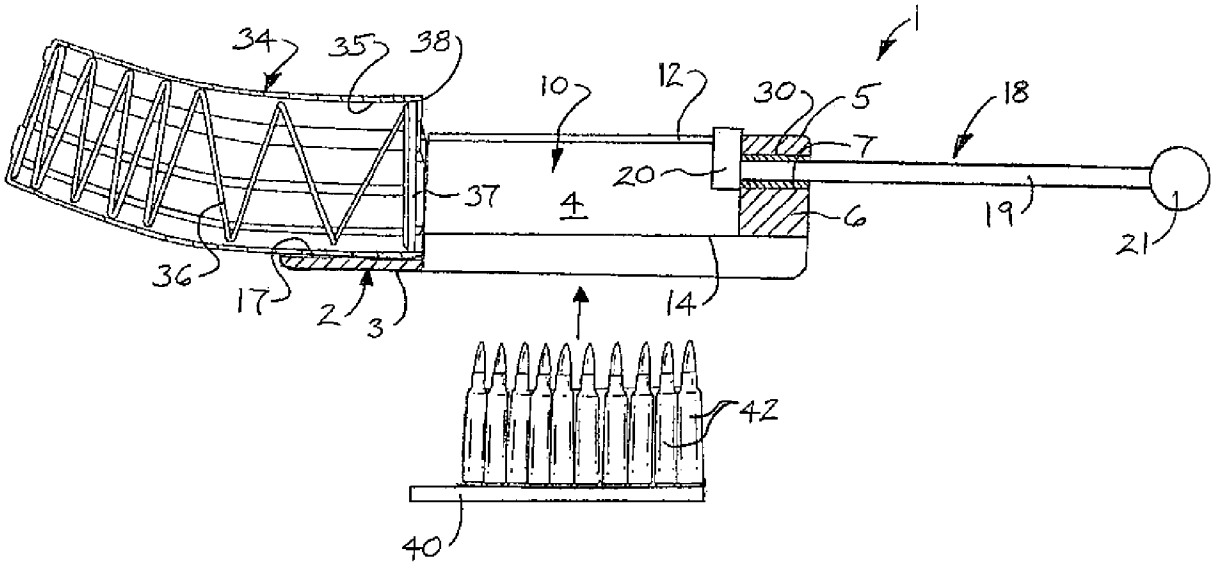
FIG. 11 is an exploded longitudinal sectional view, partially in section, of the illustrative magazine loader, with an ammo magazine (also in longitudinal sectional view) attached to the magazine loader and an stripper clip with multiple ammo rounds attached to the stripper clip in typical placement of the ammo rounds into the magazine loader.
Figure 12:
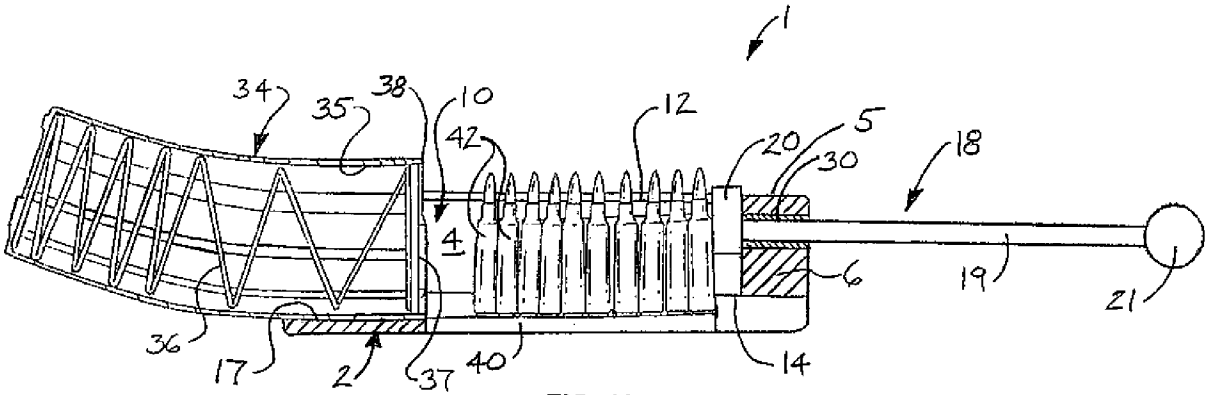
FIG. 12 is a longitudinal sectional view of the illustrative magazine loader and the stripper clip with the ammo rounds placed into the magazine loader preparatory to loading the ammo rounds from the magazine loader into the ammo magazine.
Figure 13:
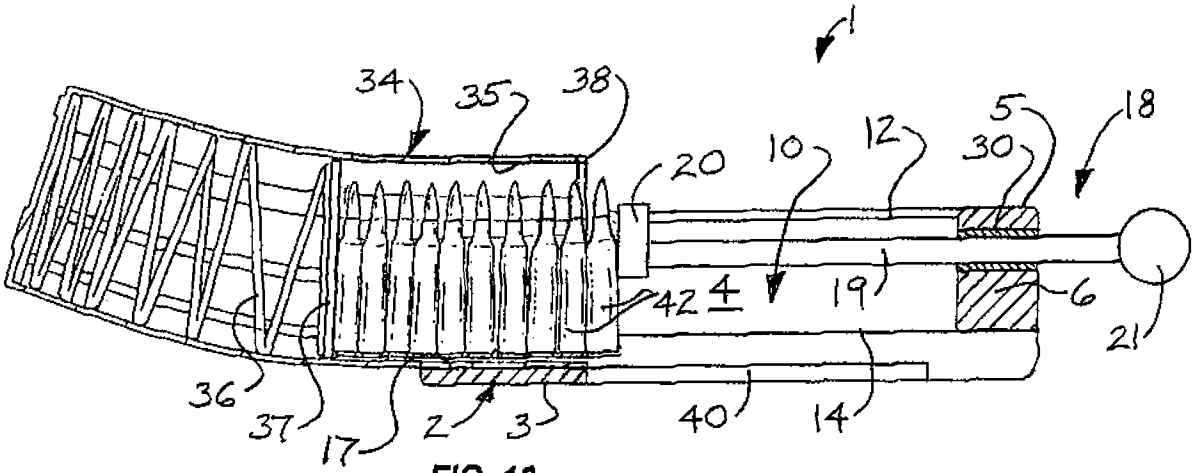
FIG. 13 is a longitudinal sectional view of the illustrative magazine loader and the ammo magazine, with the ammo loading plunger of the magazine loader disposed in a partially-retracted loading position as the ammo rounds are loaded from the stripper clip into the ammo magazine.

Referring next to FIGS. 11-13 of the drawings, in typical application, the magazine loader 1 facilitates expeditious loading of ammo rounds 42 from a stripper clip 40 into an ammo magazine 34 for a firearm. In some applications, the ammo rounds 42 may include 0.223 ammo for automatic or semiautomatic rifles used in military or police operations. Accordingly, the ammo magazine 34 is attached to the loader housing 2 of the magazine loader 1 typically by inserting the round insertion end 38 of the ammo magazine 34 into the magazine space 16 and the magazine insertion slot 17 between the wall end portions 8 of the loader housing 2. The ammo magazine 34 may include a magazine tab (not illustrated) which snaps into the correspondingly-shaped magazine tab opening 9 in one of the wall end portions 8 to detachably secure the ammo magazine 34 to the loader housing 2. The ammo magazine 34 may have a conventional design with a magazine interior 35, a magazine spring 36 deployed within the magazine interior 35 and a push plate 37 which is engaged by the magazine spring 36 and is normally positioned at the round insertion end 38 when the ammo magazine 34 is empty.

The ammo support rail 24 (FIG. 2) is initially removed from the companion clip slot 14 in the housing bottom wall 3 of the loader housing 2. The ammo loading plunger 18 is deployed in the extended ammo preloading position with the plunger head 20 typically abutting against the housing end 6. As illustrated in FIG. 11, multiple ammo rounds 42 are releasably attached to and extend from the stripper clip 40. The stripper clip 40 may be conventional and typically includes an ammo groove (not illustrated) in which the ammo rounds 42 are inserted. Accordingly, the stripper clip 40 with the extending ammo rounds 42 are inserted through the clip slot 14 and into the housing interior 10 typically from beneath or beside the loader housing 2, as further illustrated in FIG. 11. Therefore, the stripper clip 40 is disposed within the clip slot 14 and the ammo rounds 42 are disposed within the housing interior 10, as illustrated in FIG. 12. The ammo loading plunger 18 is then operated to push the ammo rounds 42 from the stripper clip 40 against the push plate 37 and into the magazine interior 35 of the ammo magazine 34. This is accomplished by pushing the plunger rod 19 through the plunger rod bushing 30 in the housing end wall 6 of the loader housing 2 from the ammo preloading position to the ammo loading position as the plunger head 20 engages and then pushes the ammo rounds 42 from the stripper clip 40 into the magazine interior 35 against the bias imparted by the magazine spring 36, as illustrated in FIG. 13. As the ammo loading plunger 18 pushes the ammo rounds 42 into the ammo magazine 34, the stripper clip 40 engages the housing bottom 3 and remains stationary in the clip slot 14.

After the ammo rounds 42 are retained inside the magazine interior 35 typically by operation of a conventional retaining mechanism (not illustrated) in the magazine interior 35, the ammo loading plunger 18 is returned to the extended preloading configuration illustrated in FIGS. 11 and 12. The vacant stripper clip 40 may next be removed from the clip slot 14 and another set of ammo rounds 42 on an additional stripper clip 40 loaded into the ammo magazine 34 as was heretofore described with respect to FIGS. 11-13. In the foregoing manner, the ammo magazine 34 can be loaded to capacity with the ammo rounds 42 in a quick and efficient manner. Thus, the magazine loader 1 may enhance military and law enforcement performance during military combat conditions or crime fighting efforts at a high level of safety. After it has been loaded, the ammo magazine 34 may be detached from the loader housing 2 and removed from the magazine space 16 and the magazine insertion slot 17. The loaded ammo magazine 34 may be attached to a firearm (not illustrated) for chambering and firing of the ammo rounds 42 from the firearm typically in the conventional manner.

Figure 14:
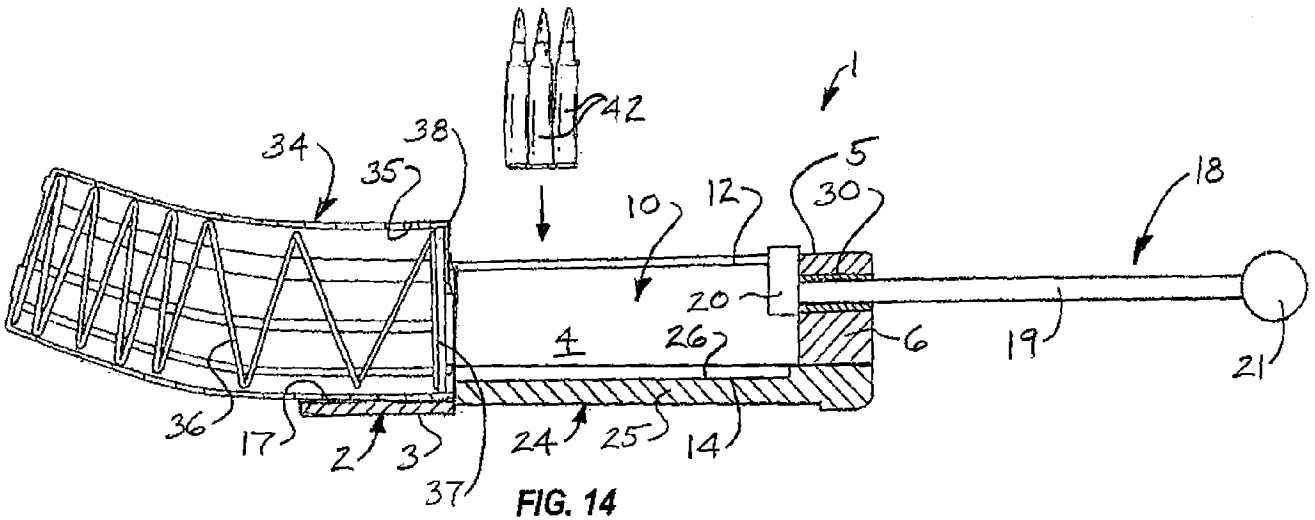
FIG. 14 is a longitudinal sectional view of the illustrative magazine loader with the ammo magazine attached to the magazine loader and more particularly illustrating placement of open ammo rounds into the magazine loader preparatory to loading the ammo rounds from the magazine loader into the ammo magazine.
Figure 15:
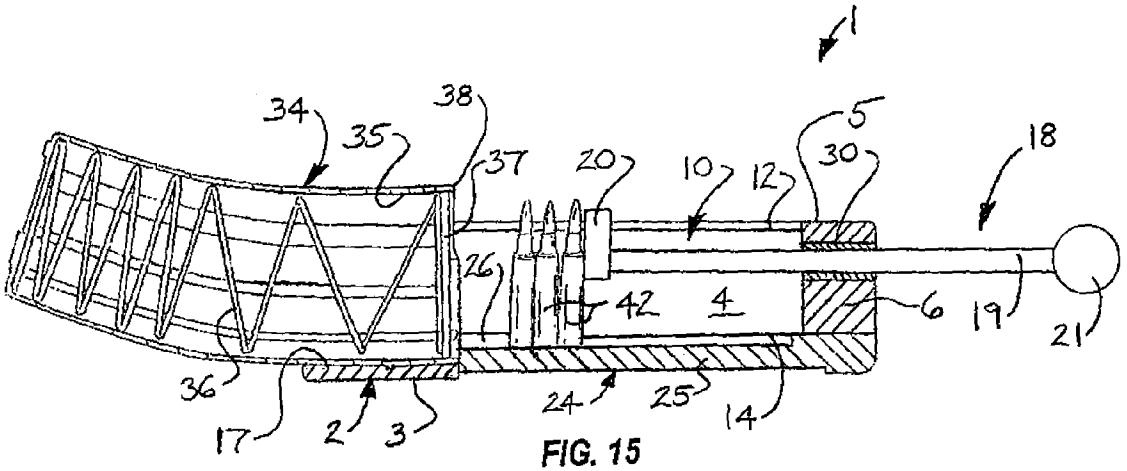
FIG. 15 is a longitudinal sectional view of the illustrative magazine loader, with the ammo loading plunger disposed in a partially-retracted loading position as the open ammo rounds are loaded from the stripper clip into the ammo magazine.

Referring next to FIGS. 14 and 15 of the drawings, in some applications, the magazine loader 1 can be used to load open ammo rounds 42 which are not attached to a stripper clip 40 (FIG. 11) into the ammo magazine 34. Accordingly, the ammo support rail 24 is slidably inserted in the clip slot 14. The ammo loading plunger 18 is deployed in the extended preloading position illustrated in FIG. 14. One or multiple open ammo rounds 42 can be inserted through the ammo slot 12 into the housing interior 10 such that the ammo support rail 24 supports the ammo rounds 42, as illustrated in FIG. 15. The ammo loading plunger 18 can then be slidably displaced in the plunger rod bushing 30 from the ammo preloading position to the ammo loading position as the plunger head 20 engages and pushes the ammo rounds 42 initially along the ammo support rail 24 and then against the push plate 37 of the ammo magazine 34. Continued displacement of the ammo loading plunger 18 facilitates loading of the ammo rounds 42 from the housing interior 10 of the loader housing 2 into the magazine interior 35 of the ammo magazine 34 against the bias imparted by the magazine spring 36 and the push plate 37. Individual ammo rounds 42 can continue to be loaded into the ammo magazine 34 in the foregoing manner typically until the capacity of the ammo magazine 34 is reached.

It will be appreciated by those skilled in the art that the magazine loader 1 is applicable to a variety of rifles including but not limited to AR and AK automatic and semiautomatic rifles used in military or police operations. The magazine loader 1 can be used to implement loading of ammo rounds 42 into an ammo magazine 34 from 10-round stripper clips 40 in a quick and safe manner in the field, potentially saving lives. Moreover, successive stripper clips 40 which carry the ammo rounds 42 can be loaded into the ammo magazine 34 until the ammo magazine 34 is filled to capacity without having to detach the ammo magazine 34 from the magazine loader 1 between loads. In this manner, the magazine loader 1 can be used to load a 30-round ammo magazine 34 in seconds. Moreover, the ammo support rail 24 can be selectively deployed in place in the clip slot 14 to facilitate loading of open ammo rounds 42 into the ammo magazine 34, as was heretofore described with respect to FIGS. 14 and 15. The loader housing 2, the ammo loading plunger 18 and the ammo support rail 24 may be fabricated of steel, aluminum, composite materials and/or other materials using casting, molding, machining and/or other manufacturing processes and techniques known by those skilled in the art.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A magazine loader, comprising:

a loader housing having a housing interior;

an ammo slot in the loader housing, the ammo slot communicating with the housing interior;

a clip slot in the loader housing opposite the ammo slot, the clip slot communicating with the housing interior;

an ammo support rail detachably disposed in the clip slot in sliding relation to the loader housing; and an ammo loading plunger carried by the loader housing and extending into the housing interior, the ammo loading plunger positional between an extended ammo preloading position and a retracted ammo loading position in the housing interior.

2. The magazine loader of claim 1 wherein the ammo loading plunger comprises a plunger rod carried by the loader housing, a plunger head carried by the plunger rod in the housing interior and a plunger handle carried by the plunger rod outside the housing interior.

3. The magazine loader of claim 1 wherein the loader housing comprises a pair of spaced-apart housing sides, a housing end connecting the housing sides at a first end of the loader housing and a housing bottom connecting the housing sides at a second end of the loader housing, and wherein the housing interior is formed by and between the housing sides.

4. The magazine loader of claim 3 further comprising a rod opening in the housing end, and wherein the ammo loading plunger extends through the rod opening.

5. A magazine loader, comprising:

a loader housing having a housing interior, the loader housing including a pair of spaced-apart housing sides, a housing end connecting the housing sides at a first end of the loader housing and a housing bottom connecting the housing sides at a second end of the loader housing, the housing interior is formed by and between the housing sides;

an ammo slot in the loader housing, the ammo slot communicating with the housing interior;

a clip slot in the loader housing opposite the ammo slot, the clip slot communicating with the housing interior;

an ammo loading plunger carried by the loader housing and extending into the housing interior, the ammo loading plunger positional between an extended ammo preloading position and a retracted ammo loading position in the housing interior; and a pair of tapered housing end portions extending from the housing sides, respectively, and wherein the housing bottom extends between the housing end portions, and a magazine space between the housing end portions and the housing bottom and communicating with the housing interior.

6. The magazine loader of claim 5 further comprising a magazine insertion slot in the housing bottom and communicating with the magazine space.

7. The magazine loader of claim 6 further comprising a magazine tab opening in at least one of the housing end portions.

8. A magazine loader, comprising:

a generally elongated loader housing having a housing interior, the loader housing having a first surface and a second surface opposite the first surface;

an elongated ammo slot in the first surface of the loader housing, the ammo slot communicating with the housing interior;

a clip slot in the second surface of the loader housing opposite the ammo slot, the clip slot communicating with the housing interior;

an ammo support rail detachably disposed in the clip slot in sliding relation to the loader housing; and an ammo loading plunger carried by the loader housing and extending into the housing interior, the ammo loading plunger positional between an extended ammo preloading position and a retracted ammo loading position in the housing interior.

9. The magazine loader of claim 8 wherein the ammo loading plunger comprises a plunger rod carried by the loader housing, a plunger head carried by the plunger rod in the housing interior and a plunger handle carried by the plunger rod outside the housing interior.

10. The magazine loader of claim 8 wherein the loader housing comprises a pair of spaced-apart housing sides, a housing end connecting the housing sides at a first end of the loader housing and a housing bottom connecting the housing sides at a second end of the loader housing, and wherein the housing interior is formed by and between the housing sides.

11. The magazine loader of claim 10 further comprising a rod opening in the housing end, and wherein the ammo loading plunger extends through the rod opening.

12. A magazine loader, comprising:

a generally elongated loader housing having a housing interior, the loader housing having a first surface and a second surface opposite the first surface, the loader housing including a pair of spaced-apart housing sides, a housing end connecting the housing sides at a first end of the loader housing and a housing bottom connecting the housing sides at a second end of the loader housing, and the housing interior is formed by and between the housing sides;

an elongated ammo slot in the first surface of the loader housing, the ammo slot communicating with the housing interior;

a clip slot in the second surface of the loader housing opposite the ammo slot, the clip slot communicating with the housing interior;

an ammo loading plunger carried by the loader housing and extending into the housing interior, the ammo loading plunger positional between an extended ammo preloading position and a retracted ammo loading position in the housing interior; and a pair of tapered housing end portions extending from the housing sides, respectively, and wherein the housing bottom extends between the housing end portions, and a magazine space between the housing end portions and the housing bottom and communicating with the housing interior.

13. The magazine loader of claim 12 further comprising a magazine insertion slot in the housing bottom and communicating with the magazine space.

14. The magazine loader of claim 13 further comprising a magazine tab opening in at least one of the housing end portions.

15. A magazine loader, comprising:

a generally elongated loader housing including:

a pair of spaced-apart housing sides;

a housing end connecting the housing sides at a first end of the loader housing;

a rod opening in the housing end;

a housing bottom connecting the housing sides at a second end of the loader housing;

a housing interior formed by and between the housing sides; and the loader housing having a first surface and a second surface opposite the first surface;

an elongated ammo slot in the first surface of the loader housing, the ammo slot communicating with the housing interior;

a clip slot in the second surface of the loader housing opposite the ammo slot, the clip slot communicating with the housing interior and extending from the housing bottom through the housing end;

an ammo support rail detachably disposed in the clip slot in sliding relation to the loader housing; and an ammo loading plunger including:

a plunger rod extending through the rod opening in the housing end in sliding relation to the loader housing;

a plunger head carried by the plunger rod in the housing interior; and a plunger handle carried by the plunger rod outside the housing interior.

16. The magazine loader of claim 15 further comprising a pair of tapered housing end portions extending from the housing sides, respectively, and wherein the housing bottom extends between the housing end portions, and a magazine space between the housing end portions and the housing bottom and communicating with the housing interior.

17. The magazine loader of claim 16 further comprising a magazine insertion slot in the housing bottom and communicating with the magazine space.

18. The magazine loader of claim 17 further comprising a magazine tab opening in at least one of the housing end portions.

* * * * *